United States Patent [19]

Snyder

[11] Patent Number: 4,848,585

[45] Date of Patent: Jul. 18, 1989

[54] JEWELRY STORAGE CASE

[75] Inventor: Jeffrey Snyder, New York, N.Y.

[73] Assignee: Etna Products Co. Inc., New York, N.Y.

[21] Appl. No.: 246,767

[22] Filed: Sep. 20, 1988

[51] Int. Cl.[4] ..... B65D 1/34

[52] U.S. Cl. ..... 206/566; 206/45.14; 206/495; 206/472; 206/315.11; 312/310; 220/4 C

[58] Field of Search ..... 206/45.14, 315.11, 472, 206/493, 495, 566; 312/107, 308, 310; 220/4 C

[56] References Cited

U.S. PATENT DOCUMENTS

| | | | |
|---|---|---|---|
| 2,539,302 | 1/1951 | Fye | 312/107 |
| 3,635,350 | 1/1972 | Wolf | 220/23.4 |
| 3,786,982 | 1/1974 | Rakes et al. | 220/324 |
| 3,948,579 | 4/1976 | Schirmer | 206/315.11 |
| 4,058,356 | 11/1977 | Michal | 206/566 |
| 4,240,222 | 12/1980 | Covington | 206/315.11 |
| 4,324,446 | 4/1982 | LeSage | 206/566 |
| 4,413,736 | 11/1983 | Nibling | 206/556 |
| 4,420,084 | 12/1983 | Whelan | 206/566 |
| 4,641,750 | 2/1987 | Johnson et al. | 206/472 |
| 4,720,012 | 1/1988 | Dufour | 206/495 |
| 4,765,466 | 8/1988 | Ivey | 206/472 |
| 4,778,051 | 10/1988 | Schaub et al. | 206/472 |

*Primary Examiner*—David T. Fidei
*Attorney, Agent, or Firm*—Henry R. Lerner

[57] ABSTRACT

A jewelry storage case includes three jewelry containing trays for holding a plurality of jewelry items, each tray including a plurality of apertures in the base thereof and at least one tray including a plurality of hooks in the base thereof for removably securing a plurality of jewelry items to the tray; a first cover for covering one outermost tray; a second cover for covering the other outermost tray; upper and lower hinge sections for hingedly securing the three jewelry containing trays together; and hubs on the covers for hingedly securing the covers to the hinge sections and thereby to the trays such that each tray and the first and second covers can pivot with respect to each other.

11 Claims, 3 Drawing Sheets

JEWELRY STORAGE CASE

BACKGROUND OF THE INVENTION

This invention relates generally to jewelry storage cases, and more particularly, is directed to a jewelry storage case having a plurality of compartments for hanging and organizing jewelry items.

Most women today have a large number of jewelry items, such as earrings, rings, necklaces and the like. Because of the generally small nature of such jewelry items, they are often stored in jewelry boxes which are intended to rest on a flat surface, such as a dresser, table or the like, such jewelry boxes containing a few compartments for storing the different jewelry items. Because the compartments are relatively large, numerous items of jewelry are generally stored in each compartment.

However, the jewelry boxes occupy much space on the flat surface, which is disadvantageous. Further, because numerous jewelry items are stored in each compartment, the jewelry items tend to become entangled and mixed with each other, making it difficult to easily retrieve the jewelry items. In addition, many jewelry boxes have removable trays which are stacked one on the other. With such arrangement, it is necessary to remove the upper trays to retrieve jewelry items from the lower compartments.

OBJECTS AND SUMMARY OF THE INVENTION

Accordingly, it is an object of the present invention to provide a jewelry storage case for holding and organizing jewelry items.

It is another object of the present invention to provide a jewelry storage case that stores and organizes jewelry items in a tangle free manner.

It is still another object of the present invention to provide a jewelry storage case that occupies a minimum amount of surface space.

It is yet another object of the present invention to provide a jewelry storage case in which the compartments formed by all of the trays are simultaneously accessible.

It is a further object of the present invention to provide a jewelry storage case that is easy and economical to manufacture and use.

In accordance with an aspect of the present invention, a jewelry storage case includes at least two jewelry containing tray means for holding a plurality of jewelry items, each tray means including a plurality of jewelry holding means for removably securing a plurality of jewelry items to the tray means; first and second cover means for covering outermost ones of said tray means and for supporting said jewelry storage case in a vertical orientation; and hinge means for hingedly securing the at least two jewelry containing tray means and the first and second cover means together such that each tray means and the first and second cover means can pivot about the hinge means with respect to each other.

The above and other objects, features and advantages of the present invention will become readily apparent from the following detailed description which is to be read in connection with the accompanying drawings.

DETAILED DESCRIPTION OF A PREFERRED EMBODIMENT

Figure 1:
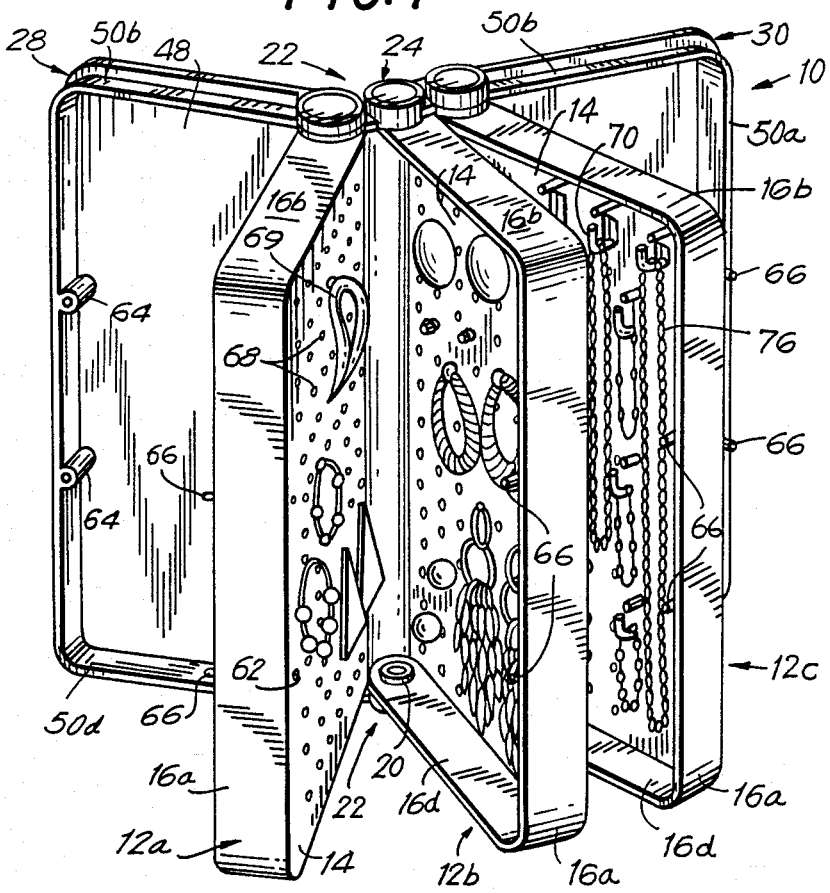
FIG. 1 is a perspective view of a jewelry storage case according to the present invention, in an opened condition.

Referring to the drawings in detail, a jewelry storage case 10 according to the present invention includes three vertically oriented trays 12*a*, 12*b* and 12*c* which are hinged together and which form three vertically oriented compartments for holding, storing and organizing jewelry items. Each tray 12 has a substantially rectangular configuration with a rectangular base 14 and four surrounding side walls 16*a*–16*d*, with side wall 16*a* constituting the outer side wall, side wall 16*b* constituting the upper side wall, side wall 16*c* constituting the inner side wall and side wall 16*d* constituting the lower side wall. Inner side wall 16*c* has an outward curvature, the purpose of which will be made apparent from the description which follows.

In addition, each tray is formed with an upper hinge aperture 18 in upper side wall 16*b* thereof adjacent to inner side wall 16*c*, and a lower hinge aperture 20 in lower side wall 16*d* thereof adjacent to inner side wall 16*c*, hinge apertures 18 and 20 each receiving a hinge pin (to be later described), so as to hingedly secure trays 12*a*–12*c* together.

Specifically, trays 12*a*–12*c* are hinged together by hinge means 22. Hinge means 22 includes an upper hinge section 24 engaged within upper hinge apertures 18 of trays 12*a*–12*c*, a lower hinge section 26 engaged within lower hinge apertures 20 of trays 12*a*–12*c*, and covers 28 and 30 that provide a three-fold function of (a) maintaining hinge sections 24 and 26 engaged within hinge apertures 18 and 20, respectively, (b) providing a closure for the compartment defined by tray 12*a* and (c) providing support for jewelry storage case 10 so that the latter can stand vertically while permitting trays 12*a*–12*c* to be swung open.

A detailed description of upper hinge section 24 will now be given with particular attention to FIG. 5. However, it will be appreciated that lower hinge section 26 is identical to upper hinge section 24, and accordingly, it is only necessary to describe upper hinge section 24.

Figure 5:
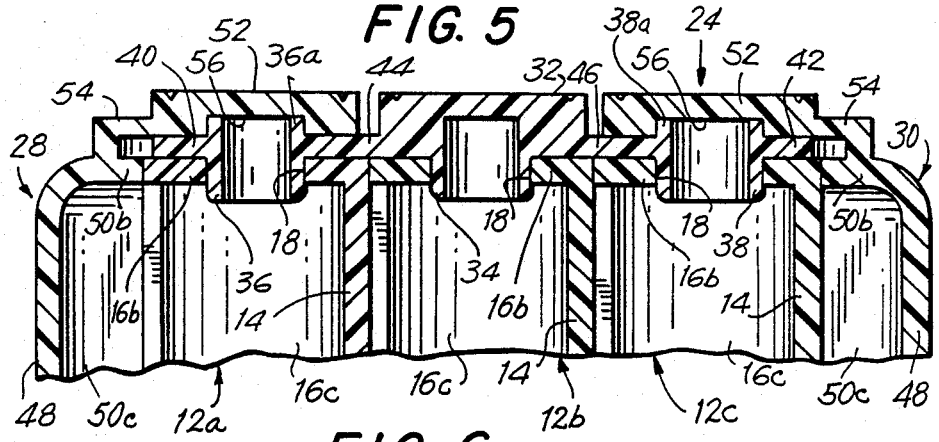
FIG. 5 is a cross-sectional view of the jewelry storage case of FIG. 2, taken along line 5—5 thereof.
Figure 6:
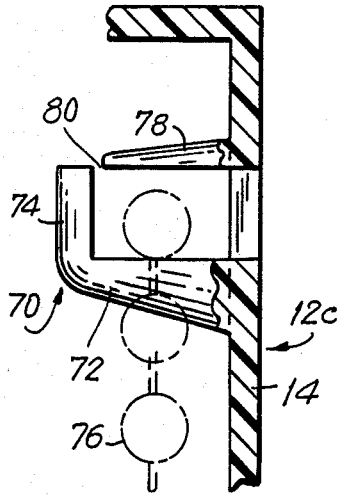
FIG. 6 is a cross-sectional view of a portion of one of the trays of FIG. 1, showing a hook for holding a necklace.
Figure 7:
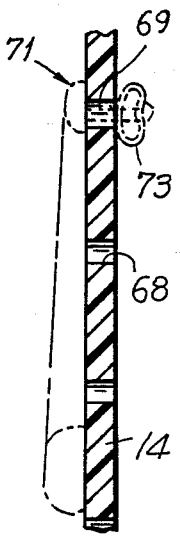
FIG. 7 is a cross-sectional view of a portion of one of the trays of FIG. 1, showing a series of apertures for holding pierced earrings.

Upper hinge section 24, as shown best in FIG. 5, includes a central hub 32 which sits on upper side wall 16*b* of tray 12*b* in surrounding relation to upper hinge aperture 18 thereat. An annular boss 34 extends downwardly from hub 32 and is non-rotatably received within upper hinge aperture 18 of tray 12*b*. In this regard, upper hinge aperture 18 can be formed with a keyway (not shown) and annular boss 34 with a key (not shown) which fits within the keyway. Annular boss 34 thereby constitutes a pivot pin for tray 12*b*. Upper hinge section 24 further includes two annular pivot shafts 36 and 38 which are rotatably received in upper hinge apertures 18 of trays 12*a* and 12*c*, each pivot shaft 36 and 38 being surrounded by an annular flange plate 40 and 42, respectively connected thereto, which sits on upper side wall 16*b* of trays 12*a* and 12*c*, respectively. Each annular flange plate 40 and 42 is connected to the respective pivot shaft 36 and 38 at a position approximately one-third of the way from the top of the pivot shaft, thereby providing an upper extension 36*a* and 38*a* of each pivot shaft, respectively. A connecting plate 44 connects annular flange plate 40 with central hub 32 and a connecting plate 46 connects annular flange plate 42 with central hub 32, so as to provide an integral structure for upper hinge section 24.

In order to maintain upper hinge section 24 within upper appertures 18 and lower hinge section 26 within lower apertures 20, covers 28 and 30 are provided, as aforementioned. Each cover 28 and 30 includes a substantially rectangular base 48 and four side walls 50*a*–50*d* extending from base 48. Side walls 50*a*–50*d* have a much shorter height than side walls 16*a*–16*d*, and are merely provided to better engage with trays 12*a* and 12*c*, respectively.

An upper annular securing hub 52 is connected to and extends inwardly from upper side wall 50*b* of each cover 28 and 30 by means of a connecting section 54. Each upper annular securing hub 52 includes a lower circular recess 56 sized to rotatably receive the upper extension 36*a* or 38*b* of pivot shafts 36 or 28, respectively, of upper hinge section 24. A lower annular securing hub 58 is connected to and extends inwardly from lower side wall 50*d* of each cover 28 and 30 by means of a connecting section (not shown). Each lower annular securing hub 58 includes a lower circular recess 60 sized to rotatably receive the lower extension 36*a* or 38*b* of pivot shafts 36 and 38, respectively, of lower hinge section 26. It will be appreciated that each lower annular securing hub 58 is identical with its respective upper annular securing hub 52 and operates in an identical manner.

All parts of jewelry storage case 10 are formed from a resilient plastic material. Accordingly, after upper hinge section 24 and lower hinge section 26 are engaged with trays 12*a*–12*c*, as aforementioned, upper and lower securing hubs 52 and 58 are deformed slightly so as to place them over upper extensions 36*a* and 38*a*, and the corresponding lower extensions, respectively. As a result, upper and lower hinge sections 24 and 26 are maintained in engagement with trays 12*a*–12*c*. Further, because of this arrangement, covers 28 and 30 can rotate with respect to trays 12*a* and 12*c*, respectively, and trays 12*a* and 12*c* can rotate with respect to center tray 12*b*. It will be appreciated, as aforementioned, that inner side walls 16*c* have an outward curvature. Therefore, when covers 28 and 30 are opened outwardly, the inner edge of cover 28 rotates about curved inner side wall 16*c* of tray 12*a* and the inner edge of cover 30 rotates about curved inner side wall 16*c* of tray 12*c*.

Preferably, the dimensions of covers 28 and 30 are greater than those of trays 12*a*–12*c*. As a result, when jewelry storage case 10 is supported vertically, as shown in FIG. 1, covers 28 and 30 provide the support for jewelry storage case 10, thereby permitting trays 12*a*–12*c* to rotate with respect thereto. This is similar to a hard cover book, in which the hard covers can support the book and the pages which are of lesser dimensions than the covers, can be hinged open.

Figure 2:
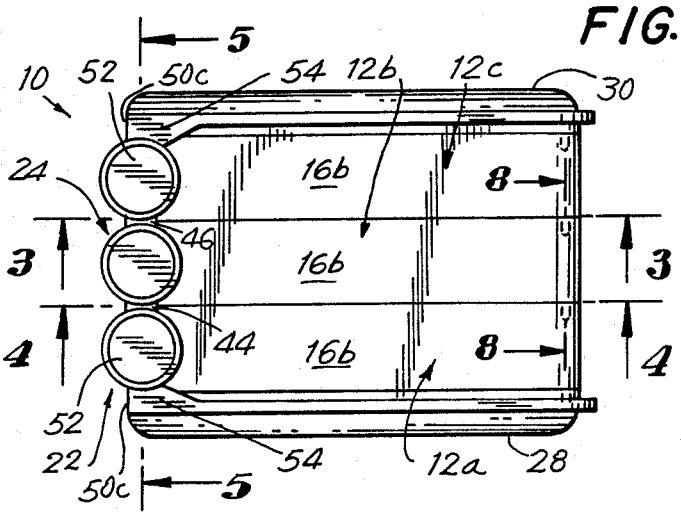
FIG. 2 is a top plan view of the jewelry storage case of FIG. 1, in a closed condition.
Figure 4:
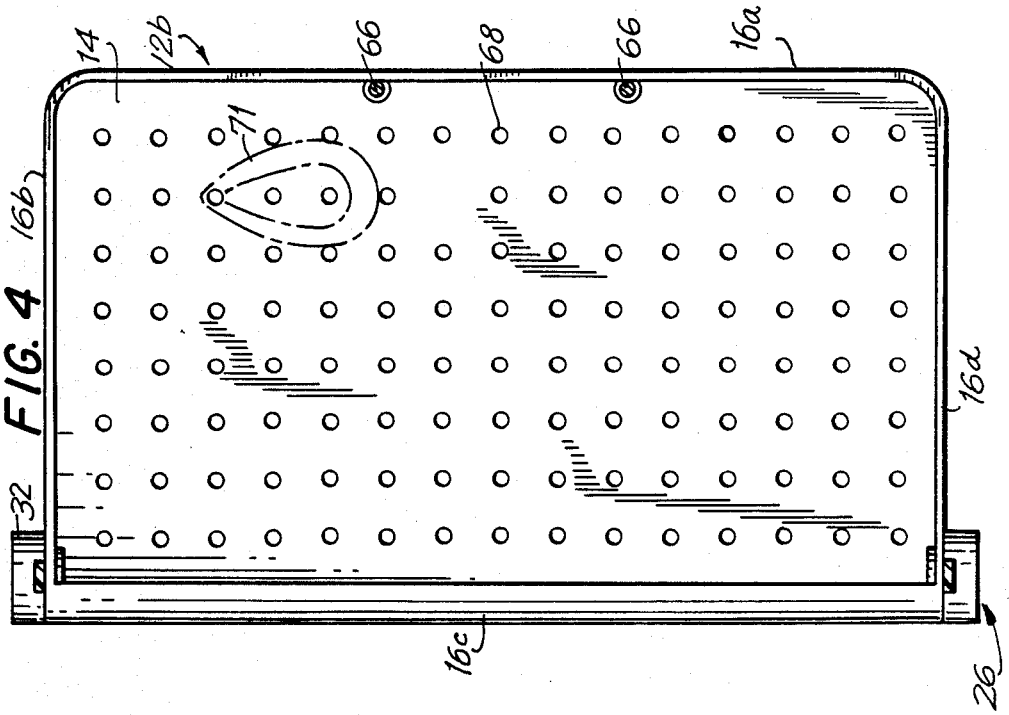
FIG. 4 is a cross-sectional view of the jewelry storage case of FIG. 2, taken along line 4—4 thereof.
Figure 3:
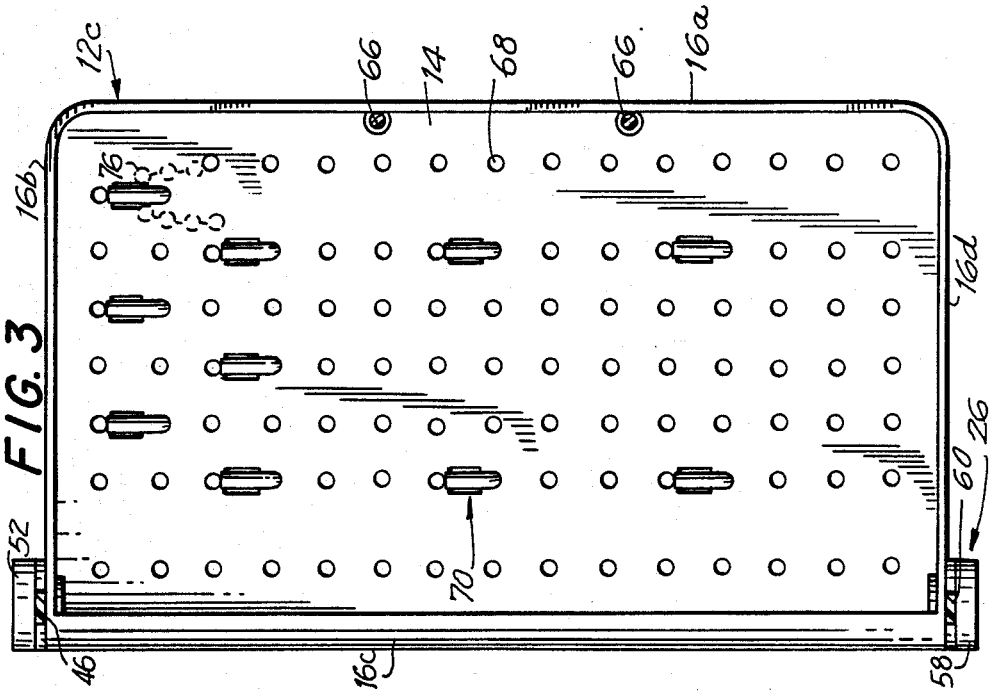
FIG. 3 is a cross-sectional view of the jewelry storage case of FIG. 2, taken along line 3—3 thereof.
Figure 8:
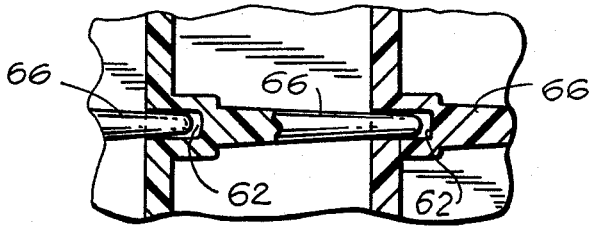
FIG. 8 is a cross-sectional view of the jewelry storage case of FIG. 2, taken along line 8—8 thereof.

In order to provide alignment between covers 28 and 30, and each of trays 12*a*–12*c*, when jewelry storage case 10 is closed in the position shown in FIG. 2, jewelry storage case 10 is provided with aligning means. Specifically, as best shown in FIGS. 1 and 8, the rear surface of each base 14 is formed with two aligning apertures 62 near the outer edge thereof, and cover 28 is formed with two hollow aligning posts 64. Cover 30 and trays 12*a*–12*c* are each formed with two aligning pins 66 near the outer edge thereof and in the compartment defined by the respective side walls thereof. Thus, aligning pins 66 of cover 30 engage within aligning apertures 62 of tray 12*c*, aligning pins 66 of tray 12*c* engage within aligning apertures 62 of tray 12*b*, aligning pins 66 of tray 12*b* engage within aligning apertures 62 of tray 12*a*, and aligning pins 66 of tray 12*a* engage within aligning posts 64 of cover 28.

As shown best in FIGS. 1, 3, 4 and 7, the base 14 of each tray 12*a*–12*c* is formed with a plurality of jewelry hanging apertures 68. Apertures 68 are provided for holding earrings. Specifically, the post 69 of an earring 71 is inserted through an aperture 68 and the back 73 of the earring clasps onto post 69 to retain earring 71 thereat. Alternatively, for backless earrings, elongated curved hooks or posts are provided in place of post 70 and merely extend through an aperture.

In addition, base 14 of tray 12*c* is formed with a plurality of hooks 70 extending into the compartment defined by tray 12*c*. Each hook 70 has an L-shaped configuration defined by a horizontally extending bar 72 extending into the compartment and an end retaining bar 74 extending upwardly from the free end of horizontally extending bar 72. In this manner, a jewelry item such as a necklace 76, ring or the like, can be hung on horizontally extending bar 72, with end retaining bar 74 preventing the necklace 76, ring or the like from falling off. In addition, an upper retaining bar 78 is associated with each hook 70. In particular, each upper retaining bar 78 extends from base 14 of tray 12*c* in parallel spaced relation from horizontally extending bar 72 and stops short of end retaining bar 74 so as to provide a small gap 80 therebetween. Upper retaining bar 78 is slightly deformable and is resilient. Accordingly, a necklace 76, ring or the like can be inserted through gap 80, after upper retaining bar 78 has been deformed upwardly, whereupon upper retaining bar 78 returns to its original position when the external force thereon is removed. Upper retaining bar 78 thereby prevents accidental escape of the necklace 78, ring or the like if jewelry storage case 10 is turned upside down.

Thus, with the present invention, jewelry storage case 10 can hold, store and organize jewelry items in a tangle free manner, while occupying a minimum amount of surface space. Further, the compartments formed by all of the trays are simultaneously accessible.

It will be appreciated that various modifications can be made to the present invention within the scope of the claims. For example, although jewelry storage case 10 has been described with three trays 12*a*–12*c*, any other suitable number of trays can be provided. In addition, hooks 70 can also be formed on trays 12*a* and 12*b*.

Having described a specific preferred embodiment of the invention with reference to the accompanying drawings, it will be appreciated that the present invention is not limited to that precise embodiment, and that various changes and modifications may be effected therein by one of ordinary skill in the art without departing from the scope or spirit of the invention as defined in the appended claims.

What is claimed is:

1. A jewelry storage case comprising:

at least two jewelry containing tray means for holding a plurality of jewelry items, each tray means including a plurality of jewelry holding means for removably securing a plurality of jewelry items to said tray means;

first and second cover means for covering outermost ones of said tray means and for supporting said jewelry storage case in a vertical orientation;

hinge means for hingedly securing said at least two jewelry containing tray means and said first and second cover means together such that each said tray means and said first and second cover means can pivot about said hinge means with respect to each other;

each tray means including a base and surrounding side walls so as to define a compartment therein, an upper one of said side walls of each tray means having an upper hinge aperture and a lower one of said side walls of each tray means having a lower hinge aperture in opposition to said upper hinge aperture, and said hinge means including an upper hinge section which engages within said upper hinge apertures of each said tray means and a lower hinge section which engages within said lower hinge apertures of each said tray means for hingedly securing said at least two jewelry containing tray means together.

2. A jewelry storage case according to claim 1, wherein there are three jewelry containing tray means hingedly connected together by said hinge means.

3. A jewelry storage case according to claim 1, wherein said upper hinge section includes upper hinge pin means for engaging within each upper hinge aperture and upper connecting means for connecting each of said upper hinge pin means together, and said lower hinge section includes lower hinge pin means for engaging within each lower hinge aperture and lower connecting means for connecting each of said lower hinge pin means together.

4. A jewelry storage case according to claim 3, wherein each cover means includes hub means for rotatably connecting said cover means to said upper and lower hinge sections and for maintaining said upper and lower hinge pin means in said upper and lower hinge apertures, respectively.

5. A jewelry storage case according to claim 1, wherein said first and second cover means have dimensions greater than those of said tray means so that said first and second cover means can support said jewelry storage case in a vertical orientation while permitting pivotal movement of said at least two tray means with respect thereto.

6. A jewelry storage case according to claim 1, wherein each tray means includes a base and surrounding side walls so as to define a compartment therein, and said jewelry holding means includes a plurality of apertures in each said base for receiving and holding earring posts.

7. A jewelry storage case according to claim 1, wherein each tray means includes a base and surrounding side walls so as to define a compartment therein, and said jewelry holding means includes a plurality of hook means extending from at least one said base into said compartment for receiving and holding earring posts.

8. A jewelry storage case according to claim 7, wherein said jewelry holding means further includes upper retaining bar means extending from said base and associated with each said hook means for preventing accidental escape of said jewelry items from said hook means.

9. A jewelry storage case according to claim 1, further including aligning means for aligning said at least two tray means and said first and second cover means when said jewelry storage case is in a closed condition.

10. A jewelry storage case according to claim 9, wherein said aligning means includes at least one aligning pin on each of said at least two tray means and on at least one of said cover means and at least one aligning aperture on each of said at least two tray means and on the other of said cover means for receiving said at least one aligning pin of an adjacent tray means and cover means.

11. A jewelry case comprising:

at least two jewelry containing tray means for holding a plurality of jewelry items, each tray means including a plurality of jewelry holding means for removably securing a plurality of jewelry items to said tray means;

first and second cover means for covering outermost ones of said tray means and for supporting said jewelry storage case in a vertical orientation;

hinge means for hingedly securing said at least two jewelry containing tray means and said first and second cover means together such that each said tray means and said first and second cover means can pivot about said hinge means with respect to each other;

each tray means including a base and surrounding side walls so as to define a compartment therein, and said jewelry holding means including a plurality of hook means extending from at least one said base into said compartment for receiving and holding earring posts;

said jewelry holding means further including upper retaining bar means extending from said base and associated with each said hook means for preventing accidental escape of said jewelry items from said hook means.

* * * * *